US005494397A

United States Patent [19]

Wilson

[11] Patent Number: 5,494,397

[45] Date of Patent: Feb. 27, 1996

[54] LOAD HANDLING APPARATUS

[75] Inventor: James Wilson, Sunderland, United Kingdom

[73] Assignee: Caterpillar Inc., Peoria, Ill.

[21] Appl. No.: 256,662

[22] PCT Filed: Jan. 20, 1993

[86] PCT No.: PCT/GB93/00122

§ 371 Date: Jul. 14, 1994

§ 102(e) Date: Jul. 14, 1994

[87] PCT Pub. No.: WO93/14016

PCT Pub. Date: Jul. 22, 1993

[30] Foreign Application Priority Data

Jan. 20, 1992 [GB] United Kingdom ..... 9201157

[51] Int. Cl.[6] ..... B66F 9/065

[52] U.S. Cl. ..... 414/728; 212/349; 52/115

[58] Field of Search ..... 414/718, 728, 414/918; 212/268, 349, 348, 264; 52/115, 118

[56] References Cited

U.S. PATENT DOCUMENTS

| | | | |
|---|---|---|---|
| Re. 30,905 | 4/1982 | Lester | 52/115 |
| 3,804,262 | 4/1974 | Wiencek et al. | 212/55 |
| 4,255,076 | 3/1981 | Svenning | 414/718 |
| 4,289,442 | 9/1981 | Stevens | 414/629 |
| 4,506,480 | 3/1985 | Murrill et al. | 52/121 |

FOREIGN PATENT DOCUMENTS

| | | |
|---|---|---|
| 0036455 | 9/1981 | European Pat. Off. . |
| 0346292 | 12/1989 | European Pat. Off. . |
| 2200184 | 4/1974 | France . |
| 2287411 | 5/1976 | France . |
| 2384705 | 10/1978 | France . |
| 2553396 | 4/1985 | France . |
| 2648122 | 12/1990 | France . |
| 1594096 | 7/1981 | United Kingdom . |
| 2106860 | 4/1993 | United Kingdom . |

*Primary Examiner*—Donald W. Underwood
*Attorney, Agent, or Firm*—Claude F. White

[57] ABSTRACT

A load handling apparatus for a vehicle includes a telescopic boom pivotably mounted on a chassis frame of the vehicle. The boom has first, second, third, and fourth sections telescopically engaged in sequence and mounted so as to be slidable relative to one another. A first hydraulic ram is adapted to move the first and second sections together by way of a synchronizing arrangement, and a second hydraulic ram moves the third section relative to the fourth section. The first section carries a load receiving device and a hydraulic unit for manipulating the load receiving device.

5 Claims, 6 Drawing Sheets

LOAD HANDLING APPARATUS

This invention relates to load handling apparatus comprising a telescopic boom carrying a hydraulic unit for manipulating a load receiving device.

Such apparatus is already known in which the telescopic boom has three sections. The first section carries the hydraulic unit and is adapted to carry the load receiving device; a hydraulic ram acts between the second and third sections; synchronising means extend and retract the First section in synchronism with the second section; and the third section is tiltably mounted on a vehicle.

Using a fork as the load receiving device it is possible to unload containers up to 9 m long, by inserting the boom through one end of the container. However, longer containers (e.g. 12 m) raise the problem of achieving a telescopic boom which has a sufficiently long telescoping range. Increasing the length of the sections increases the retracted length of the boom. However, increasing the number of sections raises the problem of supplying hydraulic fluid to the hydraulic unit along the widely variable length of the telescopic boom.

In one aspect of the present invention, a load handling apparatus includes a telescopic boom having first, second, third, and fourth telescopically interengaged sections. A first hydraulic ram is connected to the second and third sections and is operable to move the second section between a fully retracted position and a fully extended position. The apparatus further includes a synchronizing means for moving the first section between a fully retracted position and a fully extended position relative to the second section in response to the movement of the second section relative to the third section. A second hydraulic ram is connected to the third and fourth sections and is operable to move the third section relative to the fourth section. A plurality of rolling hoses for communicating hydraulic fluid move with the telescopic sections.

The invention will be described, by way of example, with reference to the accompanying drawings, in which.

Figure 1:
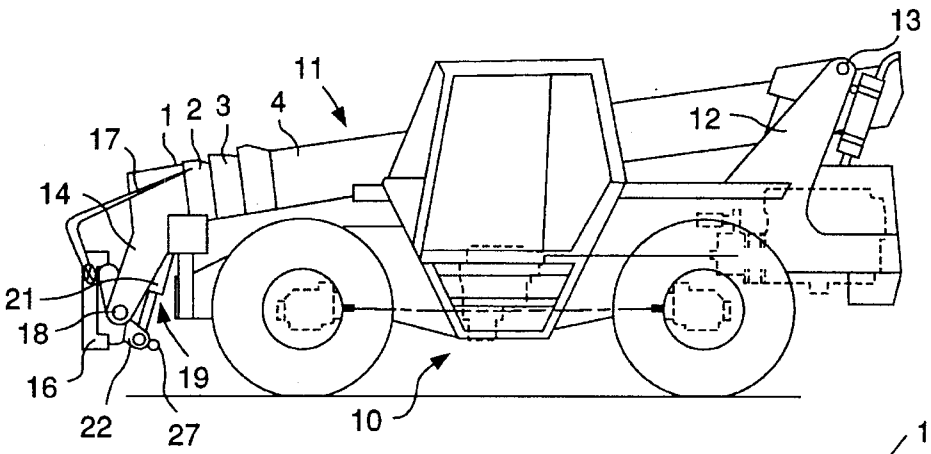
FIG. 1 is a side elevation of a vehicle equipped with load handling apparatus including a telescopic boom carrying a hydraulic unit for manipulating a load receiving device.

The vehicle 10 illustrated in FIG. 1 has a telescopic boom 11 which is tiltably mounted on a chassis frame 12 and can be raised and lowered about a pivot 13 by means of a hydraulic ram (not shown) connected between the boom 11 and the frame 12. At the front end the boom 11 has a bracket 14 adapted to carry a load receiving device 16 which includes a fork 17 and which is tiltable about a pivot 18. The front end of the boom 11 also carries a hydraulic unit 19 including a ram 21, for manipulating the load receiving device 16. In FIG. 1 the vehicle 10 is shown in its travelling position, with the boom 11 fully retracted and stowed in its lowest tilting position, the load receiving device 16 being tilted to a median position, and the fork 17 being raised and folded backwards from its normal operating position on the load receiving device 16.

Figure 10:
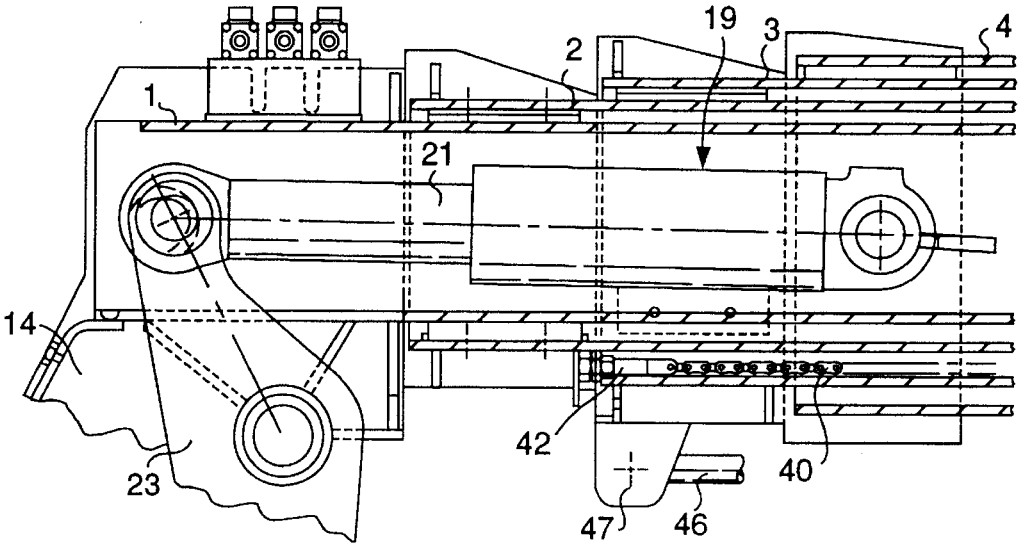
Figure 11:
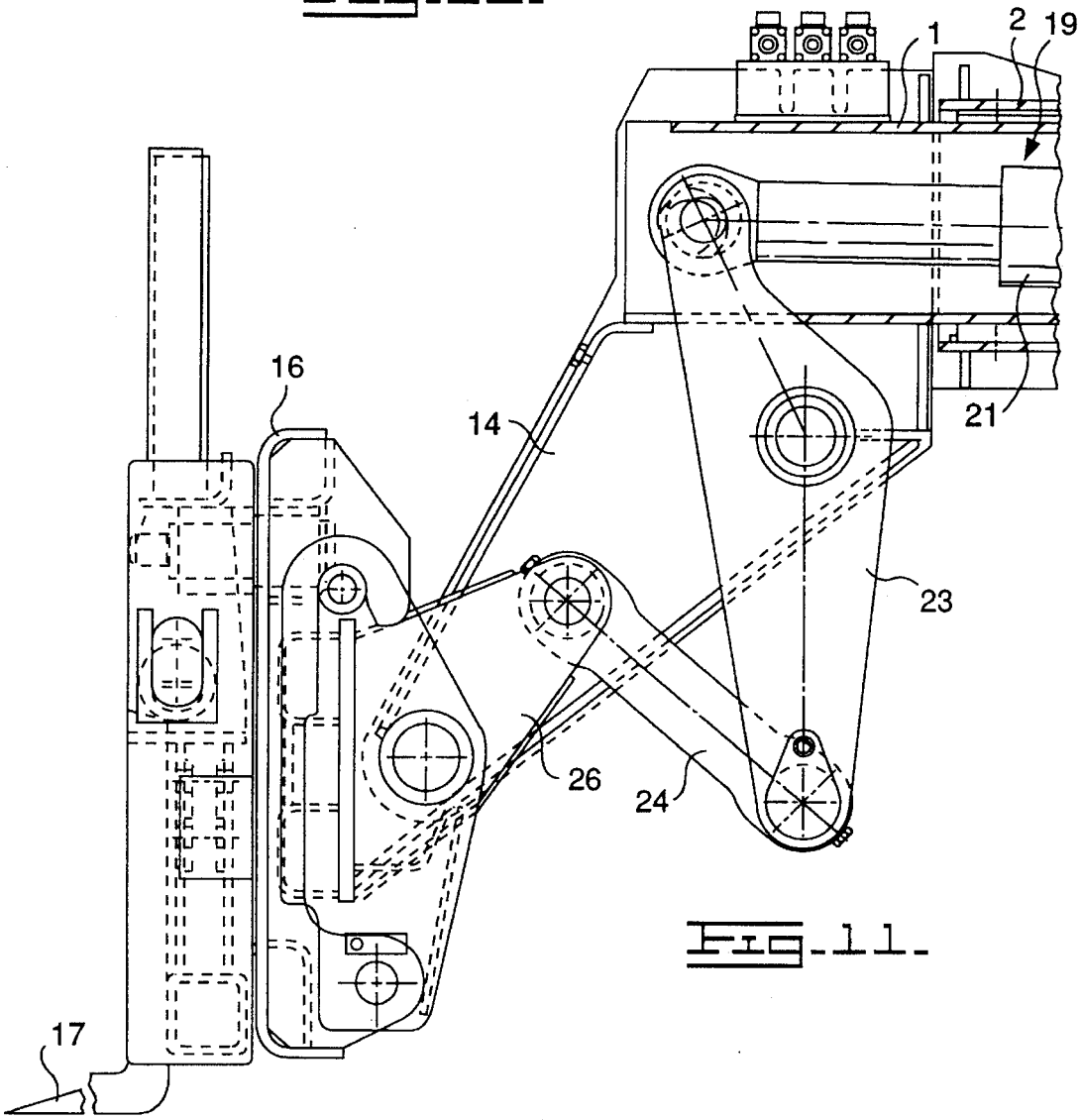

In FIG. 1 the manipulating ram 21 projects from the boom 11 and is pivoted to a lug 22 on the load receiving device 16. FIGS. 10 and 11 show an alternative arrangement in which the ram 21 is housed in the boom 11 and is connected by a lever 23 and a link 24 to a lug 26 on the load receiving device 16.

The load receiving device 16 carries castor wheels 27 for supporting the device 16 on the ground when the extended boom 11 is tilted down and the device 16 is tilted backwards about the pivot 18.

Figure 5:
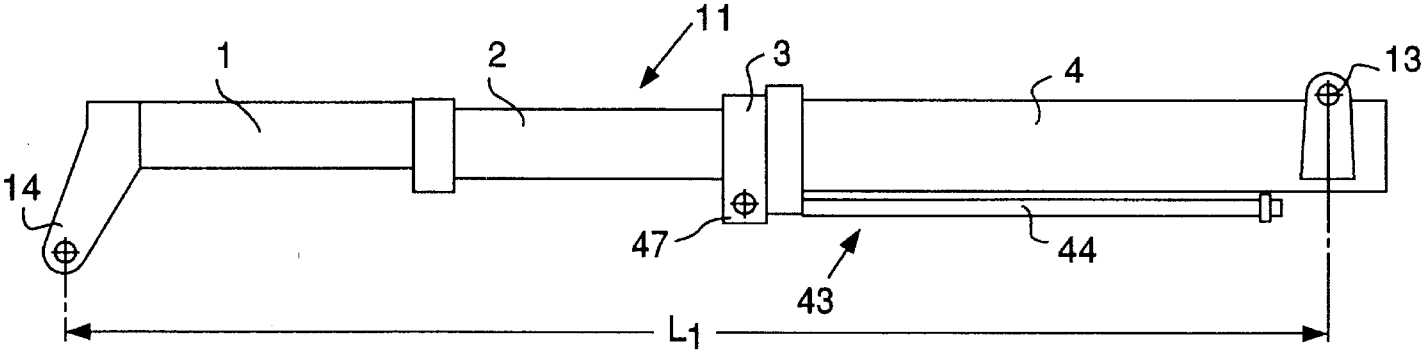
FIG. 5 is a diagrammatic side view of the boom in a partly extended state.

The boom 11 has four sections 1 to 4 telescopically engaged in sequence and mounted so as to be slidable relative to one another. The first section 1 carries the bracket 14 and the hydraulic manipulating unit 19. The second section 2 accommodates the cylinder 28 of a first hydraulic ram 29 extending longitudinally of the boom 11. The rear end of the cylinder 28 is fixedly mounted on the rear end of the second section 2 and its front end carries a bracket 31 which bears slidingly on the first section 1 via a roller 32. The rear end of the hollow ram piston 33 is fixedly mounted on the rear end of the third section 3, the ram 29 being operable (by hydraulic fluid supplied to a connector 34 on the piston 33) to move the second section 2 between a fully retracted position (FIG. 1) and a fully extended position (FIGS. 5 and 6) relative to the third section 3.

Figure 2:
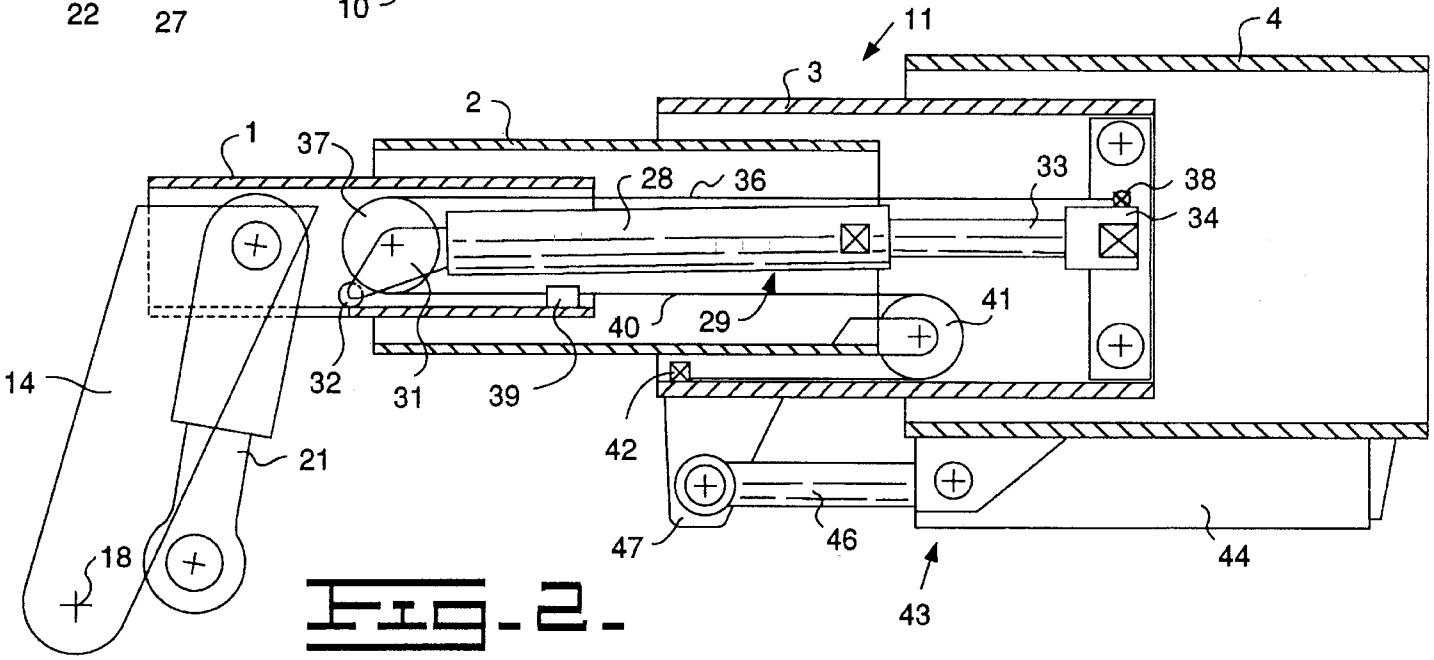
FIG. 2 is a diagram showing means for extending and retracting the boom.

The first section 1 is moved between a fully retracted position (FIG. 1) and a fully extended position (FIGS. 5 and 6) relative to the second section 2 (in synchronism with the movement of the second section 2 relative to the third section 3) by a synchronising arrangement (FIG. 2) comprising a chain 36 (or other flexible element), which passes round a pulley 37 mounted on the bracket 31 and which has one end fixed to an anchorage 38 at the rear end of the third section 3 and the other end fixed to an anchorage 39 at the rear end of the section section 2, and a chain 40, which passes round a pulley 41 mounted on the rear end of the second section 2 and which has one end fixed to the anchorage 39 and the other end fixed to an anchorage 42 the front end of the third section 3.

Figure 6:
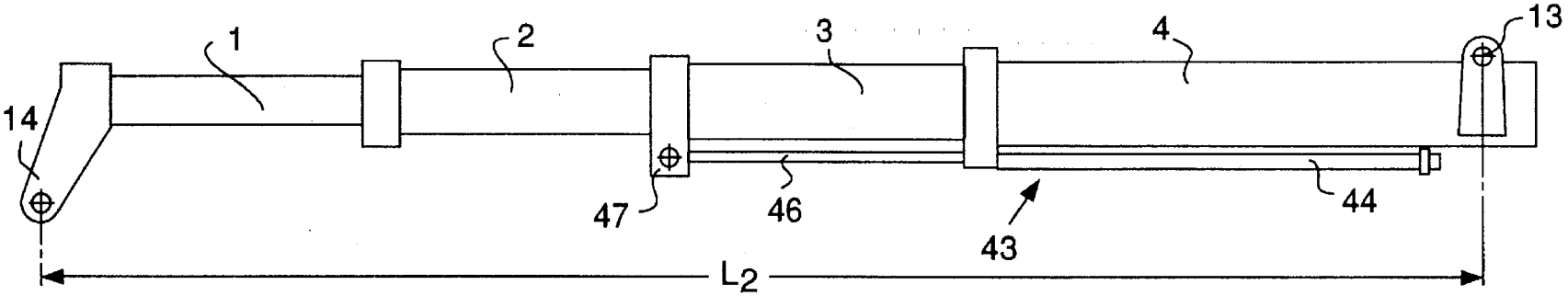
FIG. 6 is a diagrammatic side view of the boom in a fully extended state.

A second hydraulic ram 43, extending longitudinally of the boom 11, has a cylinder 44 fixed on the outside of the fourth section 4 of the boom 11 and has a piston 46 whose front end is connected to an external lug 47 at the front end of the third section 3. The ram 43 is operable (by hydraulic fluid supplied from a hydraulic control unit—not shown—to the cylinder 44) to move the third section 3 relative to the fourth section 4 between a fully retracted position (FIGS. 1 and 5) and a fully extended position (FIG. 6).

Figure 3:
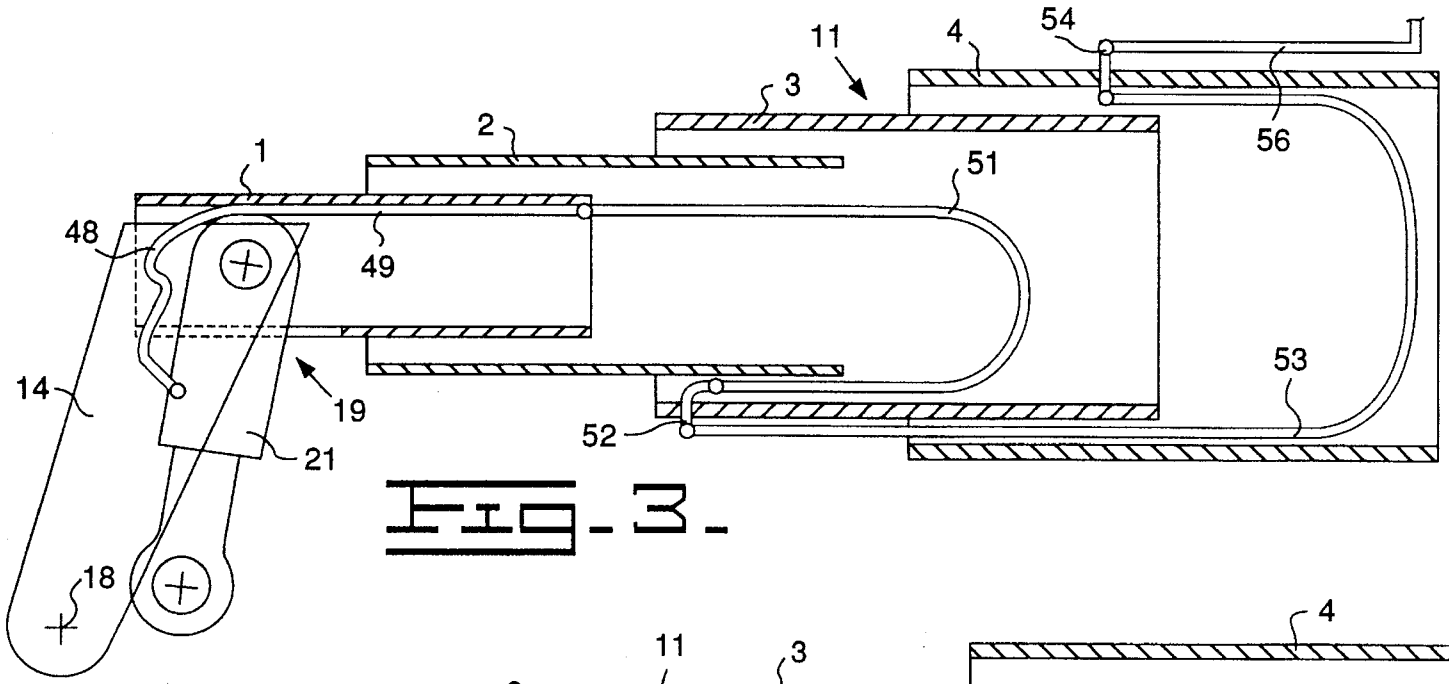
FIG. 3 is a diagram showing means for supplying hydraulic fluid to the hydraulic unit for manipulating the load receiving device.
Figure 4:
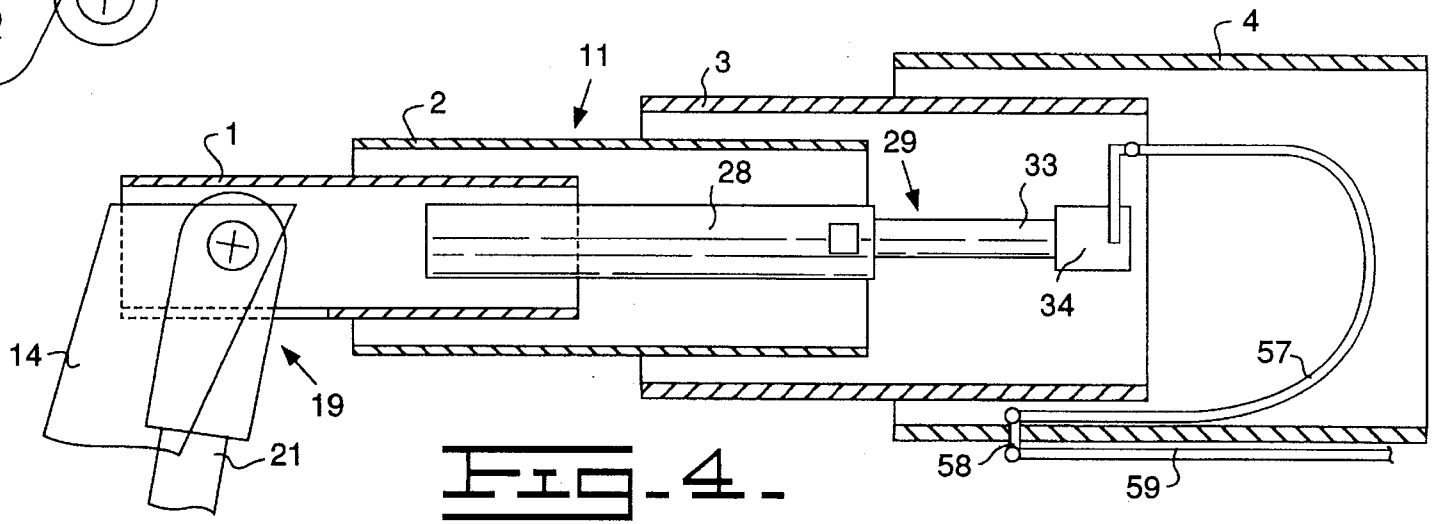
FIG. 4 is a diagram showing means for supplying hydraulic fluid to a ram for extending part of the boom.

The hydraulic manipulating unit 19 is supplied with hydraulic fluid in the following way (FIG. 3). The ram 21 is connected by a hose 48 to the front end of a fixed pipe 49 extending along the first section 1 of the boom 11. A first rolling hose 51 communicates between the rear end of the pipe 49 and a first connector 52 mounted at the front end of the third section 3. A second rolling hose 53 communicates between the first connector 52 and a second connector 54 mounted near the front end of the fourth section 4. The second connector 54 is connected to a pipe 56 which is connected in turn to the hydraulic control unit (not shown). The hoses 51,53, which roll between U-shaped and J-shaped configurations as the boom 11 is extended and retracted, are of sufficient length to allow full extension of the boom.

A third rolling hose 57 communicates between the connector 34 of the first ram 29 and a third connector 58 at the front end of the fourth section of the boom 11. The connector 58 is connected to a pipe 59 which is connected in turn to the hydraulic control unit (not shown).

Figure 7:
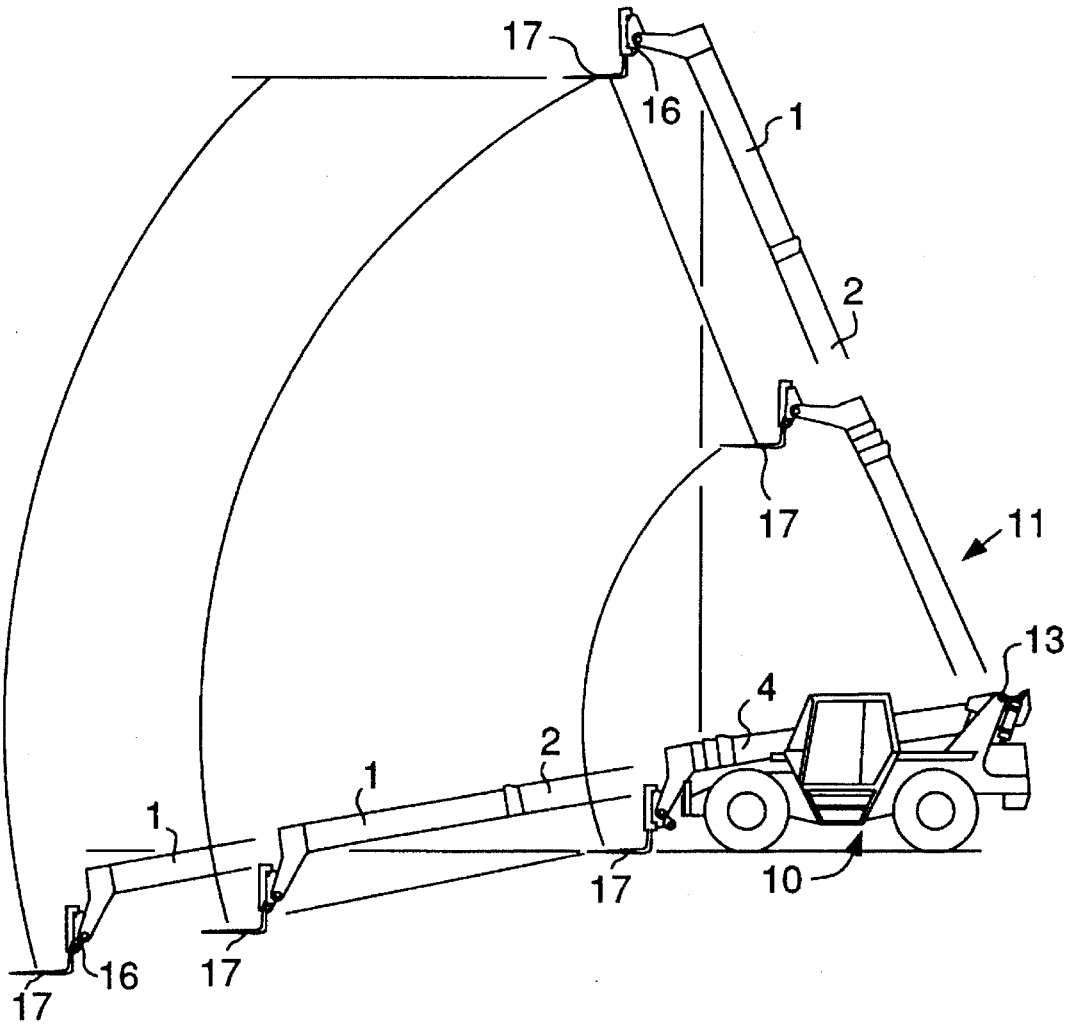
FIG. 7 is a diagrammatic side elevation of the vehicle, showing various possible positions of the boom.
Figure 8:
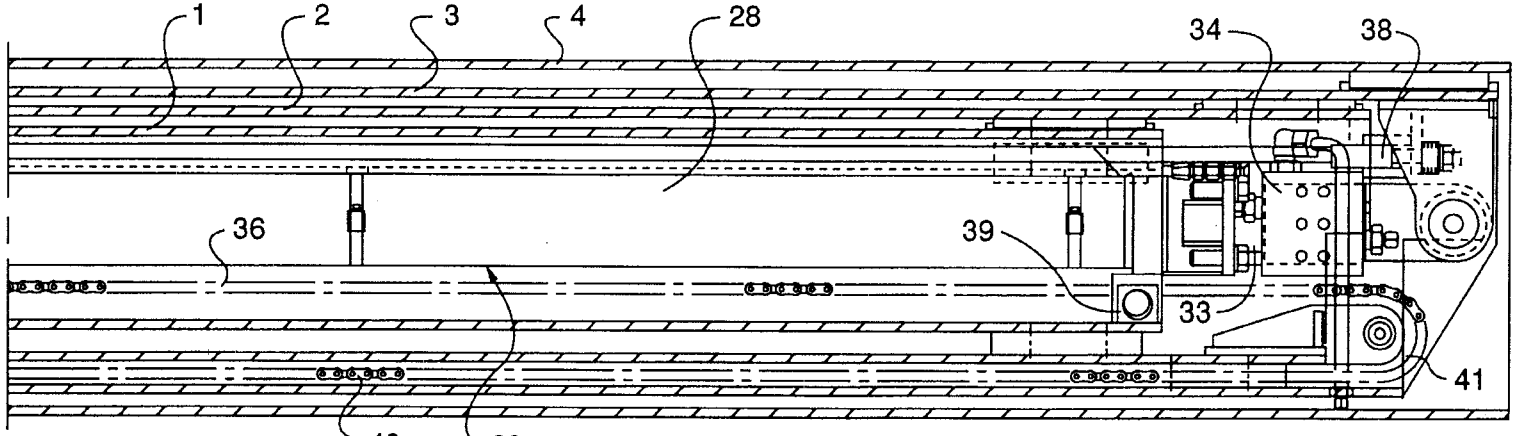
FIGS. 8 to 11 show parts of a preferred embodiment of the telescopic boom, in vertical cross-section, with certain items omitted for the sake of clarity.
Figure 9:
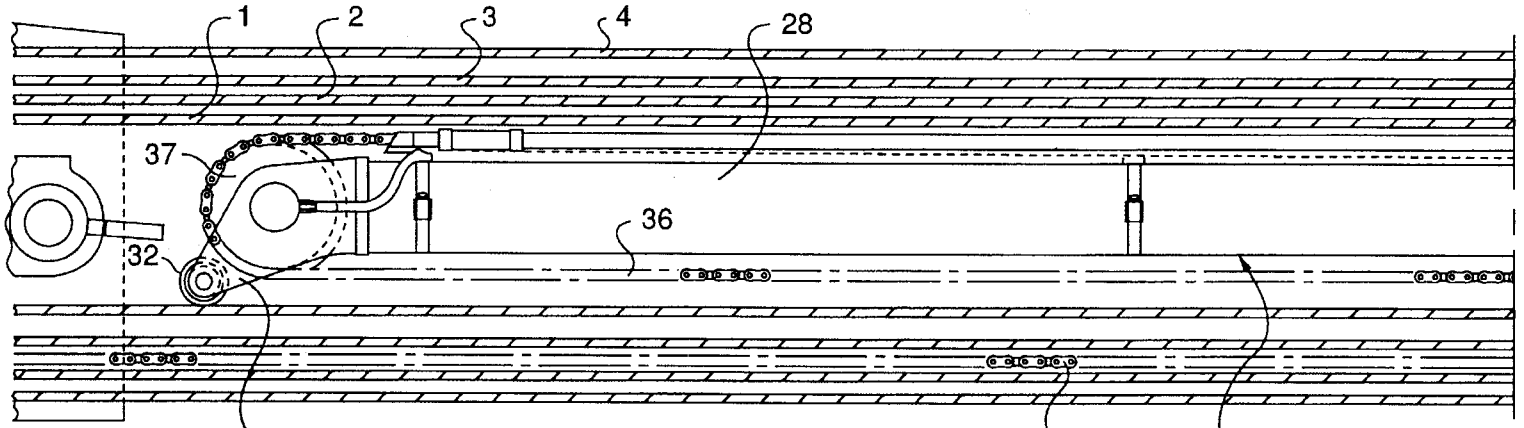

The hydraulic control unit is operable to move the load bearing device 16 across the entire range of positions indicated in FIG. 7. In particular the second ram 43 is only operable to extend the third section 3 if the first ram 29 is fully extended and the angle of elevation of the boom 11 is below an upper limit. The manipulating ram 21 is controlled by the hydraulic control unit in dependence on the angle of elevation of the boom 11 so that the fork 17 is kept level.

The fully retracted boom 11 may have an overall length of about 6 m. When the first ram 29 is fully extended (FIG. 5) the boom length $L_1$ may be about 13 m. When, in addition, the second ram 43 is fully extended (FIG. 6) the boom length $L_2$ may be about 16 m.

I claim:

1. Load handling apparatus comprising a telescopic boom having first to fourth sections (1–4) telescopically interengaged in sequence, the first section (1) carrying a hydraulic unit (19) for manipulating a load receiving device, a first hydraulic ram (29) extending longitudinally of the boom (11), being connected to the second and third sections (2,3), and being operable to move the second section (2) between a fully retracted position and a fully extended position relative to the third section (3), synchronising means (36–42) connected between the first, second and third sections for moving the first section (1) between a fully retracted position and a fully extended position relative to the second section (2) in response to movement of the second section (2) relative to the third section, a second hydraulic ram (43) extending longitudinally of the boom (11), being connected to the third and fourth sections (3,4), and being operable to move the third section (3) between a fully retracted position and a fully extended position relative to the fourth section (4), a first rolling hose (51) communicating between the hydraulic unit (19) and a first connector (52) mounted on the third section (3), a second rolling hose (53) communicating between the first connector (52) and a second connector (54) mounted on the fourth section (4), and a third rolling hose (57) communicating between the first hydraulic ram (29) and a third connector (58) mounted on the fourth section (4).

2. Apparatus as claimed in claim 1, further comprising a load receiving device (16) tiltably mounted on the first section (1) of the boom (11) and linked to the hydraulic unit (19).

3. Apparatus as claimed in claim 2, in which the load receiving device (16) has wheels (27) which can contact the ground when the load receiving device is tilted to a predetermined position relative to the boom (11).

4. Apparatus as claimed in claim 2, in which the hydraulic unit (19) comprises a ram (21) mounted within the first section (1) of the boom (11) and connected to the load receiving device (16) via a lever (23) projecting from the first section (1).

5. Apparatus as claimed in claim 1, in which the fourth section (4) of the boom (11) is pivotably mounted to allow elevation of the boom, means being provided to control the extension of the boom in relation to the elevation of the boom.

* * * * *